US005740510A

United States Patent [19]

Van den Bogaert et al.

[11] Patent Number: 5,740,510

[45] Date of Patent: Apr. 14, 1998

[54] ELECTROSTATOGRAPHIC MULTICOLOUR PRINTING APPARATUS FOR SINGLE PASS SEQUENTIAL DUPLEX PRINTING ON A WEB-TYPE TONER RECEPTOR MATERIAL

[75] Inventors: Jan Van den Bogaert, Schilde; Leo Vackier, 's Gravenwezel, both of Belgium

[73] Assignee: Agfa-Gevaert, Mortsel, Belgium

[21] Appl. No.: 641,070

[22] Filed: Apr. 29, 1996

[30] Foreign Application Priority Data

May 9, 1995 [EP] European Pat. Off. ..... 95201185

[51] Int. Cl.[6] ..... G03G 15/01

[52] U.S. Cl. ..... 399/298; 399/309

[58] Field of Search ..... 399/298, 299, 399/302, 306, 307–309; 101/135, 138, 171, 176–178

[56] References Cited

U.S. PATENT DOCUMENTS

| | | | |
|---|---|---|---|
| 3,580,670 | 5/1971 | Bhagat | 399/306 |
| 3,697,073 | 10/1972 | Dooley | 273/95 R |
| 4,427,285 | 1/1984 | Stange . | |
| 4,731,631 | 3/1988 | Monkelbaan et al. | 399/306 |
| 5,138,363 | 8/1992 | Yuge | 355/24 |
| 5,331,880 | 7/1994 | Miyoshi et al. | 101/177 |
| 5,420,662 | 5/1995 | Gerstner | 399/309 |
| 5,453,822 | 9/1995 | Anzai et al. | 399/299 |
| 5,526,107 | 6/1996 | Bronstein | 399/299 |
| 5,550,624 | 8/1996 | Wachtler | 399/306 |

FOREIGN PATENT DOCUMENTS 629924 12/1994 European Pat. Off. .

OTHER PUBLICATIONS

European Search Report.

*Primary Examiner*—William J. Royer
*Attorney, Agent, or Firm*—Baker & Botts, L.L.P.

[57] ABSTRACT

An electrostatographic printing apparatus is provided, suited for single-pass sequential multi-color duplex printing, characterized in that the printing proceeds by depositing and fixing toner particles on a final substrate (1) in web form. The apparatus includes two printing systems arranged in succession on opposite sides of the final substrate (1). Each of the printing systems includes an intermediate rotatable toner-receiving member (3), a device for rotationally driving the intermediate toner-receiving member (3), a device for superimposing color separation images in registration on the intermediate toner-receiving member (3), and a device for simultaneously transferring the superposed color separation images from the intermediate toner-receiving member (3) onto the final substrate (1). In a preferred embodiment, the transferring device is a drum or roller (4), optionally electrically biased, that forms with the intermediate toner-receiving member (3) a nip through which the final substrate (1) is passed in synchronism with the peripheral movement of the intermediate toner-receiving member (3). Preferably, the color separation images are applied in registration to the intermediate toner-receiving member by a plurality of rotatable image-producing electrostatographic drums.

16 Claims, 3 Drawing Sheets

ELECTROSTATOGRAPHIC MULTICOLOUR PRINTING APPARATUS FOR SINGLE PASS SEQUENTIAL DUPLEX PRINTING ON A WEB-TYPE TONER RECEPTOR MATERIAL

FIELD OF THE INVENTION

The present invention relates to an electrostatographic printing apparatus suited for single pass sequential multicolor duplex printing on a web-type receptor material.

BACKGROUND OF THE INVENTION

For many years printing proceeds with letterpress, gravure (intaglio) or planographic (lithographic) printing machines wherein a printing ink receptor, usually paper, makes direct contact with an inked printing form [ref. e.g. Printing Technology by J. Michael Adams et al.—Delmar Publishers Inc. (1988)].

Printing presses are classified into sheet-fed and web-fed printing presses.

Nowadays other printing processes, so-called non-impact printing processes have found application, e.g. electrostatographic printing, (ref. e.g. "Principles of Non-Impact Printing" by Jerome L. Johnson (1986)—Palatino Press—Irvine Calif., 92715 U.S.A.).

Electrostatographic printing includes electrographic printing in which an electrostatic charge is deposited image-wise, e.g. by ionography, on a dielectric recording member as well as electrophotographic printing in which an overall electrostatically charged photoconductive dielectric recording member is image-wise exposed to conductivity increasing radiation producing thereby a "direct" or "reversal" toner-developable charge pattern on the recording member. "Direct" development is a positive-positive development, and is particularly useful for reproducing pictures and text. "Reversal" development is of interest in or when from a negative original a positive reproduction has to be made or vice-versa, or when the exposure derives from an image in digital electrical signal form, wherein the electrical signals modulate a laser beam or the light output of light-emitting diodes (LEDs). It is advantageous with respect to a reduced load of the electric signal modulated light source (laser or LEDs) to record graphic information (e.g. printed text) in such a way that the light information corresponds with the graphic characters so that by "reversal" development in the exposed area of a photoconductive recording layer, toner can be deposited to produce a positive reproduction of the electronically stored original. In high speed electrostatographic printing the exposure derives practically always from electronically stored, i.e. computer stored information.

In order for said electrostatographic non-impact printing system to be competitive with classical "impact" or "contact" printing it has to be adapted for high speed printing at long runs and has to possess the capability of printing on both sides (duplex printing) which is common praxis in printing of books and journals.

In single pass sequential duplex printing with common printing ink, e.g. used in offset printing on web-type material, reversing or turner mechanisms are applied for reversing the web and feeding it into a next printing station [ref. e.g. "The Printing Industry" by Victor Strauss Published by Printing Industries of America Inc. 20 Chevy Chase Circle, N. W., Washington, D.C. 20015 (1967) p. 512–514].

An example of a non-impact electrophotographic printing machine for single pass sequential duplex printing on paper web is given in U.S. Pat. No. 3,694,073. The printing method described therein (see FIG. 1 of U.S. Pat. No. 3,694,073) is not suited for full color printing and allows only the printing of monochrome images on each side of the printing web.

In the printing apparatus of said United States patent number registration problems arise as is the case in full color printing wherein different monochrome ink-images (yellow, magenta, cyan and black), i.e. color separation images of in short color separations, have to be deposited in register.

Nowadays printing systems have gone digital in that the printing information is stored and fed to the printing machine in digital electronic form modulating the photo-exposure of pre-charged photoconductive imaging elements or modulating directly electrostatic charging as takes place in ionographic printing machines.

A recent survey of digital printing systems is given in "Informationen"—Wiesbaden 1/1994 Art.-Nr. 86028 (pages 1–20) by Andreas Weber, edited by Bundesverband Druck E. V. Abt. Technik+Forschung, Biebricher Allee 79, D-65 187 Wiesbaden—Germany.

In that article two new-comer electrophotographic digital duplex printing systems marketed under the tradename XEIKON DCP-1 of XEIKON N.V. Belgium and under the tradename E-PRINT 1000 of INDIGO company have been discussed respectively. The digitally operated multicolour electrophotographic printing machine XEIKON DCP-1 (tradename) (see also published EP-A 629 924 and 631 204) is capable of simultaneous duplex printing with good image registration by using a printing web driving all the photoconductive printing drums, whereas the E-PRINT 1000 (tradename) (see page 14 of the above mentioned article) operates with paper sheets and requires a turnaround mechanism for printing on both sides of the paper sheets whereby it is impossible to print continuously varying information on a receptor of practically infinite length as is possible with the web-fed XEIKON DCP-1 (tradename). Printing on paper with exceptionally long length is applied in practice e.g. in printing of a continuously varying stream of computer data or in the printing of wall paper wherein the length of the printing pattern largely exceeds the length of the printing drum.

In the duplex printer according to published EP-A 629 924 using a printing web driving all the photoconductive printing drums, the paper web makes good adherent contact with said drums over a certain wrapping angle, such requires however that following each toner-transfer corona an alternating current corona has to be present in order to ease the release of the paper web from the successive drums and to avoid sparking during that release.

Moreover, single-pass simultaneous duplex printing on a paper web with more than three printing stations in staggered position with respect to the printing web requires according to published EP-A 631 204 means for controlling the electrostatic polarity of the toner already present on the web in advance of the third and each subsequent image-producing stations, to enable the transfer of a toner image at a third and any subsequent image-producing stations without disturbing the image transferred to the same side of the web at a previous image-producing station (see claims 3 and 4 of said EP-A). The introduction of all these coronas for obtaining good printing quality with said electrostatographic duplex printer makes that a considerable amount of ozone and ionized gas are produced that may not enter into the environment and require neutralization or removal, e.g. by absorption.

OBJECTS AND SUMMARY OF THE INVENTION

It is an object of the present invention to provide an electrostatographic printing apparatus, i.e. printing machine, suited for sequential multicolour duplex printing on a web-type printing stock forming thereon in single-pass, multicolor prints consisting of monochrome color separation images (i.e. yellow, magenta, cyan and black images) in good registration at both sides of the web, avoiding the use of a particularly high number of coronas and not relying on said web for driving the printing elements, so that optionally printing stock with poor mechanical strength can be printed.

Other objects and advantages of the present invention will appear from the further description.

The objects of the present invention are realized by providing an electrostatographic printing apparatus suited for single-pass sequential multi-color duplex printing, characterized in that said printing proceeds by depositing and fixing toner particles on a final substrate (1) in web form and said apparatus comprises:

1) two printing systems, a first (I) and a second (II) one, being arranged in succession at opposite sides of said final substrate (1), each of said printing systems comprising an intermediate rotatable toner-receiving member (3),
2) means, in each of said printing systems, for rotationally driving said intermediate toner-receiving member (3),
3) means, in each of said printing systems, for superimposing color separation images in registration on said intermediate toner-receiving member (3), and
4) means, in each of said printing systems, for simultaneously transferring said superposed toner image from said toner-receiving member (3) onto said final substrate (1), said transferring means being a drum or roller (4) optionally electrically biased and forming with said intermediate toner-receiving member (3) a nip through which said final substrate (1) is passed in synchronism with the peripheral movement of said intermediate toner-receiving member (3).

DETAILED DESCRIPTION OF THE INVENTION

Figure 1:
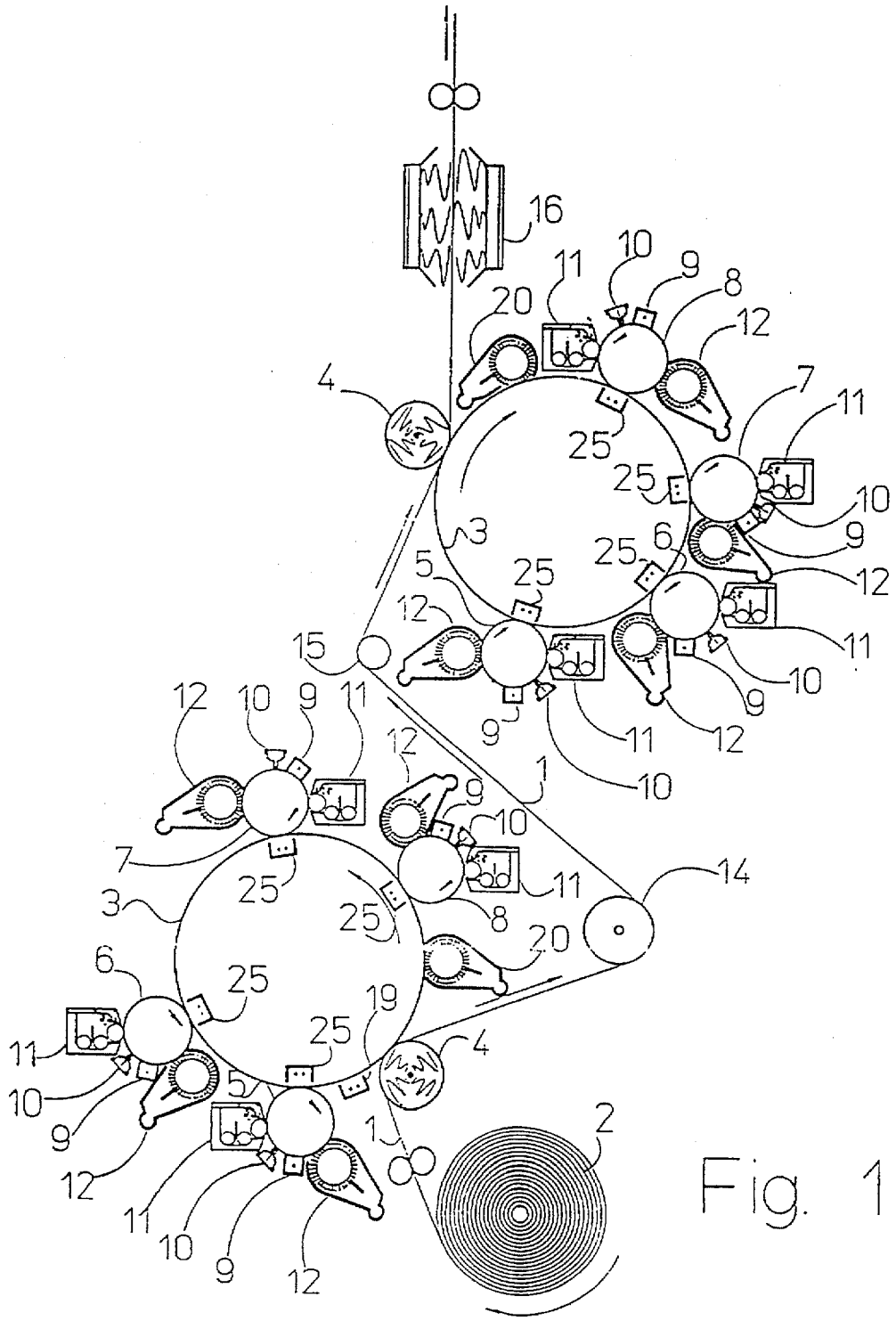
FIG. 1 represents a schematic cross-sectional view of an embodiment according to the present invention of a single pass duplex (double-side) multicolour electrostatographic printing machine wherein toner images that have been deposited on intermediate toner-receiving drums are transfixed on a final substrate in the form of a paper web.

In its broadest aspects, the present invention can be implemented in an apparatus comprising two printing systems being arranged in succession at opposite sides of a final substrate in web form, each of the printing systems comprising an intermediate rotatable toner-receiving member. On the intermediate toner-receiving member of each printing system, color separation images (i.e. a yellow, magenta, cyan and black images) are deposited in registration, by any known method for image-wise depositing toner particles on an intermediate toner-receiving member. From this intermediate toner receiving member, the color image is transferred to a final substrate in web form and ultimately fixed. Since the apparatus comprises two printing systems on opposite sides of the final substrate (in web form), both sides of the final substrate can be printed in a single pass.

The intermediate toner-receiving member have preferably an endless surface, in the form of drums or endless belts, and are electrically insulating or have an electrically insulating surface layer, e.g. insulating polymer layer on an electrically biased metal base.

A very suitable method for depositing toner particles on said intermediate toner-receiving member is the method of Direct Electrostatic Printing (DEP). In DEP a flow of charged toner particles from a toner source to a substrate is caused by a an electric field between the toner source and a backelectrode located behind said substrate. The flow of toner particles is imagewise modulated by a printhead structure, comprising printing apertures, that by applying changing electrical fields can either let toner particles pass or prevent the passing of the toner particles. When several DEP devices, each adapted for printing a color separation image, are located around the intermediate toner-receiving member in such a way that for each of the DEP devices this intermediate toner bearing member passes between a printhead structure and a backelectrode, the color separation images can in registration be applied to said intermediate toner-receiving member. Although any DEP device known in the art from several disclosures, e.g. devices known from U.S. Pat. No. 3,689,935, U.S. Pat. No. 4,320,408, U.S. Pat. No. 4,478,510, U.S. Pat. No. 4,743,926, U.S. Pat. No. 4,876,561, EP-A 390 847, U.S. Pat. No. 5,327,169, EP-A 675 417, JP-A 60/263962, etc, can be used, it is preferred to use a DEP device wherein toner particles are applied to an intermediate toner receiving member. Such a device has been disclosed in European Application 95201262, filed on May 15, 1996, that is included herein by reference. In said European Application, only one DEP device, wherein the intermediate toner-receiving member passes between a printhead structure and a back electrode is exemplified, but it is easily understood that it is possible to locate more than one DEP device such that for each DEP device, having each a printhead structure and a backelectrode, the intermediate toner bearing member passes between the printhead structure and the backelectrode.

Another useful method for depositing toner particles on the intermediate toner-receiving member is a printing device as described in EP-A 304 983. In such a printing device the color separations are made on an image-forming element in the form of a rotating drum provided with an electrostatic layer built up from a number of controllable electrodes in and beneath a dielectric layer. By imagewise applying a voltage on the controllable electrodes, toner particles are attracted from a toner source to the drum. It is possible to mount several of such image forming elements, each adapted for printing a color separation image, around the intermediate toner-receiving member of the present invention and apply the color separation images in registration on the intermediate toner-receiving member.

In a preferred embodiment of the invention, the color separation images are applied in registration to said intermediate toner-receiving member by a plurality of rotatable image-producing electrostatographic members that can be synchronously rotationally driven in contact with a common intermediate toner-receiving member, that is either a drum or an endless belt.

The image-producing electrostatographic members in an apparatus according to the present invention are endless surface members in the apparatus according to the present invention and are in the form of drums or endless belts, but are preferably in the form of drums having the same diameter. The electrostatic image can be produced on said image-producing electrostatic members either by ionography (imagewise application of charges) or by electrophotography (imagewise exposure to light of a homogeneously charged photoconductive layer). This latter embodiment is the preferred embodiment to produce images on said electrostatographic image-producing members.

For use in electrophotographic printing said drums or belts have a photoconductive coating or layer on a conductive support.

According to a preferred embodiment in the first printing system the intermediate toner-receiving member of the first printing system is a drum and is operated as a drive roller coupled to a speed controllable motor, the intermediate toner-receiving member of the second printing system is also a drum and is operated as a drive roller coupled to a torque controllable motor. Hereby speed and tension of the final substrate (in web form) are kept under control for good image registration.

The transfer of the toner images from the intermediate toner-receiving member, be it a drum or an endless belt, onto the final substrate, e.g. a paper web, proceeds by electrostatic force and pressure, optionally combined with heat resulting thereby in transfixing of the toner images on the final substrate.

So, according to an embodiment each of said intermediate toner-receiving members are drums and form a nip with a hot pressure roller, the final substrate by passing through said nip obtains a translational displacement in synchronism with the peripheral movement of said toner-receiving members. As a result thereof toner images transferred from said toner-receiving members are transfixed in registration onto said final substrate.

According to another embodiment the present printing apparatus further comprises between the first and second printing system a fusing means for fixing already the toner images transferred on the final substrate in the first printing system. For example, said fusing means comprises a backing roller for said web and a hot reversing (turnaround) roller directly contacting said toner images.

The preferred embodiments of the present invention, where the colour separation images, and optionally other toner layers as, e.g. gloss equalizing layers, protective layers, image relief equalizing layers, etc, are applied in registration on an intermediate toner-receiving member by electrophotographic means and then transferred to a final substrate being in web form will be discussed more in detail with reference to the accompanying drawings.

Referring to FIG. 1 on starting the printing machine a paper web 1 fed from a paper supply roller 2 is passed in the nip formed by an intermediate toner-receiving drum 3 and a backing roller 4 being under pressure towards said toner-receiving drum 3. Said backing roller 4 is a hot fuser roller being electrically biased for attracting the toner particles from the toner-receiving drum 3 onto paper web 1, whereon the toner particles become transfixed. The toner-receiving drum 3 has transfer coronas 25 inside opposite each photoconductive drum (5, 6, 7, 8).

In the first printing system (I) four photoconductive drums (5, 6, 7 and 8) representing respectively a cyan, magenta, yellow and black image-producing station are surrounding said toner-receiving drum 3. Each said photoconductive drum is associated at its periphery with a corona-charging source 9 for uniformly charging the photoconductive layer of the drum. An image-wise modulated light beam of a LED-array exposure source 10 is exposing each photoconductive drum according to the selected colour information, e.g. of a separation image (red, green or blue light information) of a multicolour original to be reproduced. Each photoconductive drum has its associated toner development unit 11, e.g. a magnetic brush developing unit, and cleaning unit 12, e.g. a brush cleaning unit with suction exhaust, for removing residual non-transferred toner particles.

Each toner image initially formed on its photoconductive drum is transferred by electrostatic force onto the electrically biased toner-receiving drum 3 having transfer coronas 25 inside opposite each photoconductive drum.

The photoconductive drums (5, 6, 7 and 8) are driven by the intermediate toner-receiving drum 3 of which the pressure contact with the photoconductive drums is such that the rotational movement of said drums is controlled by the peripheral speed of the outer surface of said drum 3, so that there is almost no slippage between it and the photoconductive drums. Hereby transfer of the toner image of each photoconductive drum can take place in good superposing registration onto said toner-receiving drum 3.

The hot backing roller 4 has optionally a resilient surface so that under deformation thereof by pressing it towards the toner-receiving drum 3 there is a larger heating contact with the rear side of the toner-loaded paper web, the toner-images of which are heated through the paper web. The pressure applied in the nip of said drum 3 and roller 4 makes that the paper is moved in synchronism with the peripheral movement of the toner-receiving drum 3 the axis of which is coupled to a speed controllable motor (not shown in FIG. 1).

Optionally an alternating current corona device 19 immediately preceding the nip formed by the toner-receiving drum 3 and roller 4, upstream from the paper movement direction, discharges the toner particles clinging to the toner-receiving drum and eases their transfer to the paper web 1 by the fact that they are no longer electrostatically adhered to said drum 3. The toner images that have been superposed on the toner-receiving drum are brought simultaneously into contact with the paper web 1 and transfixed thereon.

Downstream the point of toner-transfer from the intermediate toner-receiving drum 3 to paper web 1, a brush cleaning station 20 with suction exhaust removes non-transferred toner from said intermediate drum 3.

In a next stage the paper web arrives over cooling conveyor rollers 14 and 15 at a second printing system II being functionally the same as the first printing system I. In FIG. 1 the different members of the second system have obtained the same numbering as in the first system. The whole process as described for the first printing system is repeated but at the opposite side of the paper web 1. By conveying the paper web 1 through a final fixing infrared radiant station 16 the transferred toner images are more thoroughly fused and toner particle-colour better intermixed. Said fixing station 16 is followed by a cutting station (not shown in the drawing) in case prints in sheet form are required.

Figure 2:
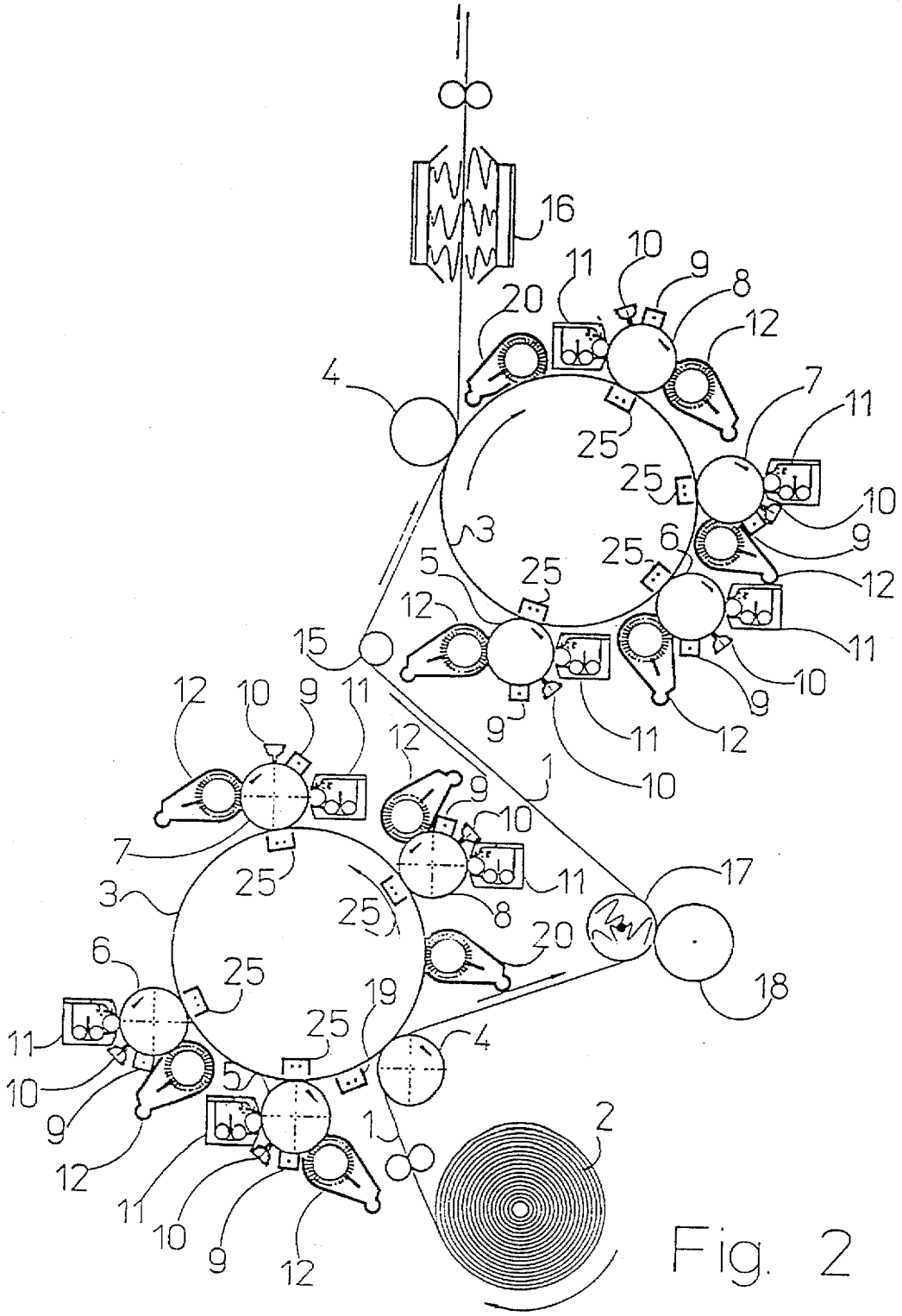
FIG. 2 represents a schematic cross-sectional view of another embodiment according to the present invention of a single pass duplex (double-side) multicolour electrostatographic printing machine wherein toner images formed in a first printing system at one side of a paper web are fixed by a hot roll fuser intermediate said first printing system and a second printing system.

FIG. 2 represents in a schematic cross-sectional view another embodiment of a single pass duplex (double-side) multicolour electrostatographic printing machine which differs from the machine illustrated in FIG. 1 in that the backing roller 4 is not internally heated and does not serve in a transfix system but a hot roller 17 with back pressure roller 18 is used for fixing the toner images obtained in the first printing system before arriving in the second printing system. The direct contact of the hot roller 17 with the toner particles makes that less heat is required for their fixing by fusing then when heat is applied through the rear side of the paper web 1 as shown in FIG. 1.

In the embodiments represented in FIGS. 1 and 2 on the axis of each toner-receiving drums 3 an encoder is fixed (not shown in the drawings) (see e.g. U.S. Pat. No. 5,119,128) for yielding timing pulses that ensure synchronism of peripheral movement of said drums.

Figure 3:
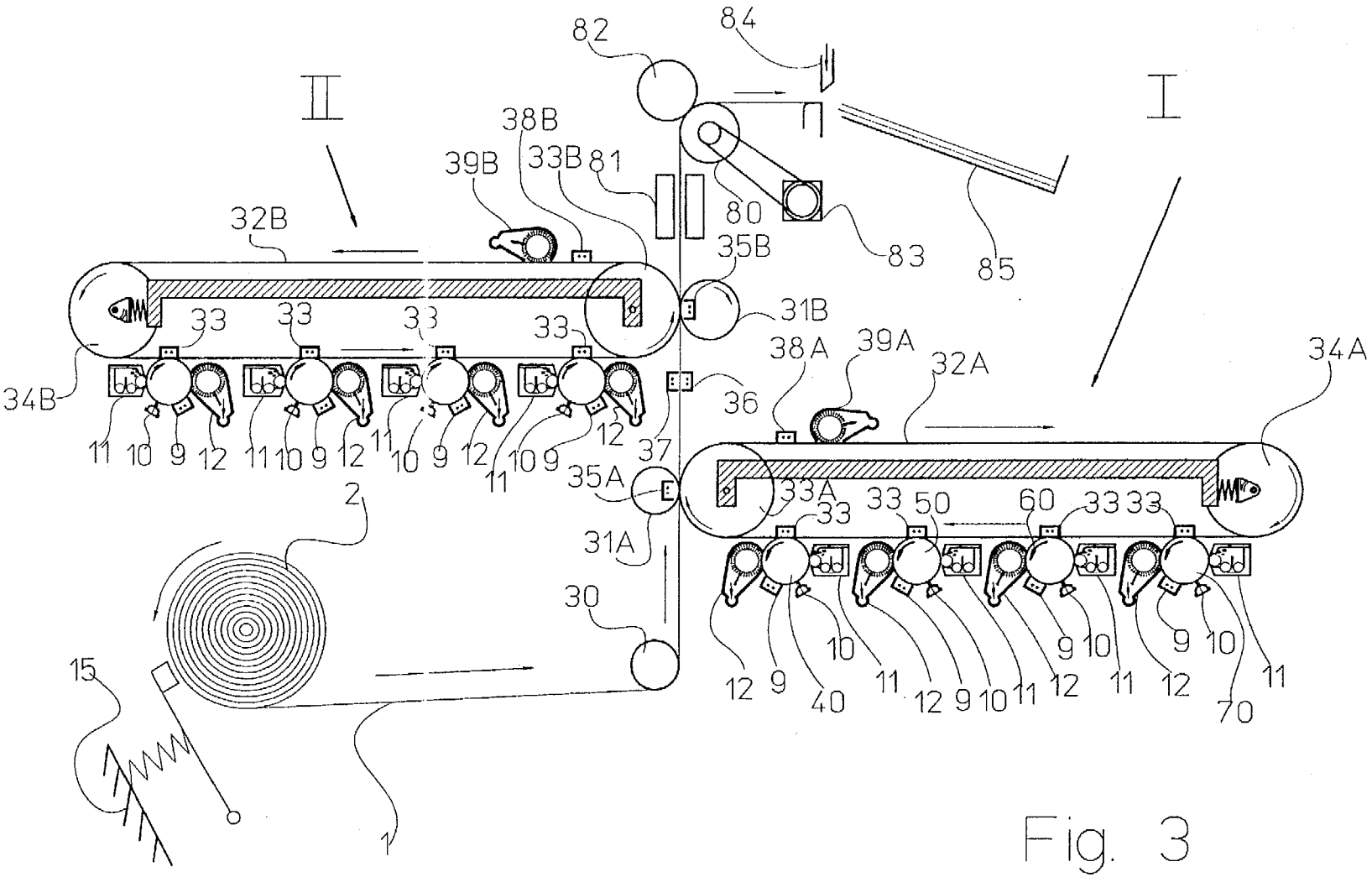
FIG. 3 represents a schematic cross-sectional view of still another embodiment according to the present invention of a single pass duplex (double-side) multicolour electrostatographic printing machine operating with a paper web driven by endless belts as intermediate toner-receiving members and wherein the toner images on the web are fixed by infra-red radiation in non-contact with the heating source.

In the printing machine illustrated in FIG. 3 a paper web 1 fed from a paper supply roller 2 combined with a web-tensioning brake 15 is conveyed by conveyor roller 30 into the nip formed by a pressure backing roller 31A and part of an intermediate toner-receiving member, being endless belt 32A that is conveyed by a driver roller 33A (connected by its axis to an electric motor—not shown in the drawing) and belt-tensioning conveyor roller 34A.

Said pressure backing roller 31A has inside a transfer corona 35A to attract the toner particles from the intermediate toner-receiving member 32A onto the paper web 1.

In the first printing system (I) four photoconductive drums (40, 50, 60 and 70) represent respectively a cyan, magenta, yellow toner and black image-producing stations positioned in contact with one side of said endless belt 32A. Each said photoconductive drum is associated at its periphery with a corona-charging source 9 for uniformly charging the photoconductive layer of the drum. An image-wise modulated light beam of a LED-array exposure source 10 is exposing each photoconductive drum according to the selected colour information, e.g. of a separation image (red, green or blue light information) of a multicolour original to be reproduced. Each photoconductive drum has its associated toner development unit 11 and cleaning unit 12, e.g. brush cleaning unit with suction exhaust, for removing residual non-transferred toner particles.

The photoconductive drums (40, 50, 60 and 70) are driven by their pressure-contact with the intermediate toner-receiving member or endless belt 32A so that each of them obtains the same peripheral movement in synchronism with the peripheral movement of said belt. The rotational movement of said intermediate toner-receiving member 32A controls also through its pressure-contact with the paper web 1 the synchronous translational movement of said web.

In order to avoid paper-slippage in the points of toner-transfer to the paper web 1 each drive roller 33A and 33B of the intermediate toner-receiving members 32A and 32B respectively is connected through its axis to a speed-controllable electric motor (not shown in FIG. 3). Said individual electric motors are operated synchronously using for their speed control an encoder (not shown in FIG. 3) on the rotation axis of said drive rollers (33A and 33B). Timing pulses provided by said encoders ensure synchronism of peripheral speed of both said intermediate toner-receiving members 32A and 32B. A suitable encoder for that purpose is described e.g. in U.S. Pat. No. 5,119,128.

Each toner image initially formed on its photoconductive drum is transferred by electrostatic force onto the electrically biased intermediate toner-receiving member 32A having transfer coronas 33 inside and opposite each photoconductive drum.

The backing roller 31A having inside a transfer corona 35A attracts the toner particles from the intermediate toner-receiving member 32A onto the paper web 1.

Before arriving in the second printing system II the toner polarity of the toner particles of the toner images already deposited on the stations web 1 in the first printing system I is reversed in order to prevent that toner particles of said first formed images transfer from the paper web 1 onto the backing roller 31B during the electrostatic transfer of the secondly formed toner images that have been deposited in superposition on the intermediate toner-receiving member 32B in the second printing system. The reversing of the charge polarity of already deposited toner proceeds with DC coronas (36, 37), wherein the corona directed to the toner particles has a charge polarity opposite to the original charge polarity of the toner applied in the first printing system.

The reversing of toner polarity as described above can be omitted by using in the second printing system toner particles of a charge polarity opposite to the charge polarity of the toner particles used in the first printing system and by applying to the backing roller 31B of the second printing system an electric bias of a polarity opposite to the polarity of the bias applied to the backing roller 31A in the first printing system.

Some fixing or sintering of the toner particles of the images formed in the first printing system before passing the receptor web into the second printing system may also prevent transfer thereof to the guiding member of the second printing system. However, such intermediate fixing, especially when applying a considerable amount of heat, may give rise to distortion of the paper web, e.g. causes wrinkling of the paper by too strongly drying, so that misregistration of the toner images formed in the second printing system may take place.

However, by carefully controlling the heat applied in said intermediate fixing stage, e.g. by reducing fixing heat in combination with pressure, that is applied e.g. directly to the toner images with a hot pressure roller, misregistration of the toner images later on formed at the other side of the receptor web may be kept at a minimum.

Downstream the point of transfer of toner from the intermediate toner-receiving member 32A to paper web 1, a brush cleaning station 39A preceded by alternating current corona 38A removes non-transferred toner from intermediate toner-receiving member 32A.

In the second printing system II the operating members of the first printing system I are repeated and indicated by same numerals followed in some instances by the letter "B" instead of "A".

Before contacting a turnaround roller 80 the toner images formed sequentially on both sides of paper web 1 are fixed with heat from an infra-red radiant station 81.

Said fixing station 81 is followed by a toner-abhesive turnaround roller 80 forming a nip with a toner-abhesive drive roller 82 driven by electric motor 83 to keep the paper web 1 straight without causing slippage thereof with respect to the intermediate toner receiving member, being endless belts 32A and 32B in the toner-transfer points. The abhesive character of the surface of said rollers 80 and 82 may be obtained with a surface coating of a highly fluorinated polymer such as poly(tetrafluoroethylene), sold under the tradename TEFLON. The turnaround roller 80 and drive roller 82 may be provided with a cleaning system (not shown in the drawing), e.g. a brush cleaner as indicated by numeral 12 for the photoconductive drums.

Optionally said turnaround roller 80 and drive roller 82 are followed by a cooling zone in which cold air is directed on the heat-fixed toner images or wherein both sides of the paper web make contact with smooth metal rollers that are cooled by cooling liquid pumped through said rollers.

When printed sheets are required the paper web 1 carrying fixed toner images at both sides is fed in a cutting station 84 and collected in a tray 85 or sorter.

In the exposure of the photoconductive drums preferably an array of light-emitting diodes (LEDs) is used as is the case likewise in the printer described in published EP-A 629 924. Exposure by laser light from a gas laser (e.g. He—Ne laser) or from a semiconductor laser (e.g. a GaAs laser) is a useful exposure method in the implementation of the present invention. The imagewise modulation of the laser light is preferably done by pulse-width-modulation and the laser beam is elliptical.

Other useful exposure sources in the form of an array of deformable mirrors (DMD=Digital Mirror Device) are described in U.S. Pat. Nos. 5,206,629, 5,289,172 and 5,369, 433.

The development of the latent electrostatic images proceeds preferably with electrostatically attractable marking material, called toner, that may be in the from of dry solid triboelectrically charged particles or in the form of a dispersion of charged toner particles in a carrier liquid (liquid developer) and such preferably according to the known principles of reversal development.

A survey of different techniques used in the development of electrostatic charge images is given in U.S. Pat. No. 5,012,288 and IEEE Transactions on Electronic Devices, Vol. ED-19, No. 4, April 1972 by Thomas L. Thourson under the title: "Xerographic Development Processes": A Review. Magnetic brush development is very reliable, herein carrier toner compositions can be used or monocomponent coloured magnetic toners as described e.g. in published EP-A 184 714. Non-magnetic toners may be used advantageously in non-magnetic contact development (ref. Journal of imaging Science and Technology—Vol. 37, No. 3, May/June 1993, p. 223–230) wherein toner against gravity adheres sufficiently strong to an electrically biased elastic development roller.

Liquid toner development may be carried out as described, e.g. in U.S. Pat. No. 4,770,967 by development liquid supplied from a tray or by ink jet or by using a liquid toner applicator having slots as described e.g. in U.S. Pat. No. 4,545,326 or by using a toner-reservoir with flow-through as described in GB-P 1,125,628.

The toner liquid may have a relatively high viscosity as described e.g. in U.S. Pat. No. 5,192,638, and may be concentrated on the intermediate roller (intermediate transfer member) by heating it thereon as described e.g. in U.S. Pat. No. 5,276,492.

Fixing of the toner images on their web support may proceed by any technique known in the art, e.g. by cold pressure roller, contact-heating with hot pressure roller, hot air steam and/or radiant heat.

A hot roller fixing device suitable for use in the embodiment of transfixing illustrated in present FIG. 1 is described e.g. in U.S. Pat. No. 4,550,243.

Transfixing by conveying the toner-imaged paper through the nip of a hot roller (4) and the surface of the already mentioned intermediate toner-receiving member (3) will result, as described in Journal of Imaging Science and Technology—Vol. 37, No. 5, September/October 1993, p. 451–461, see more particularly p. 459, in reduced edge raggedness of printed characters.

A hot roller (14) suitable for use in hot roller-pressure fixing is described e.g. in U.S. Pat. No. 4,550,243 and in IBM J. Res. Develop.—Vol. 22, No. 1 January 1978, in the article "Design of the Fusing System for an Electrophotographic Laser Printer" by K. D. Brooms.

The present duplex printer may be used for single-pass sequential double-side printing on every flexible web-type support, e.g. paper, plastified paper, plastified fabric, plastic supports, plastified metal web, cardboard, etc . . . .

We claim:

1. An electrostatographic printing apparatus suited for single-pass sequential multi-colour duplex printing, wherein said printing proceeds by depositing and fixing toner particles on a final substrate in web form and said apparatus comprises:

1) first and second printing systems arranged in succession on opposite sides of said final substrate, each of said printing systems comprising an intermediate rotatable toner-receiving member, 2) means, in each of said printing systems, for rotationally driving said intermediate toner-receiving member, 3) means, in each of said printing systems, for superimposing colour separation images in registration on said intermediate toner-receiving member, and 4) means, in each of said printing systems, for simultaneously transferring said superposed colour separation images from said intermediate toner-receiving member onto said final substrate, said transferring means being a drum or roller forming with said intermediate toner-receiving member a nip through which said final substrate is passed in synchronism with the peripheral movement of said intermediate toner-receiving member.

2. A printing apparatus according to claim 1, wherein said means for superimposing colour separation images in registration on said intermediate toner-receiving member comprises a DEP printing device.

3. A printing apparatus according to claim 1, wherein said means for superimposing colour separation images in registration on said intermediate toner-receiving member comprises an image-forming element in the form of a rotating drum provided with an electrostatic layer built up from a number of controllable electrodes in and beneath a dielectric layer.

4. A printing apparatus according to claim 1, wherein:

said means for superimposing colour separation images in registration on said intermediate toner-receiving member includes a plurality of rotatable toner-image bearing members that can synchronously be driven in contact with said intermediate toner-receiving member; and said printing apparatus further comprises means, in each of said printing systems, for rotationally driving said intermediate toner-receiving member in pressure-contact with said toner-image bearing members so that said toner-image bearing members obtain a peripheral speed substantially equal to the peripheral speed of said intermediate toner-receiving member.

5. A printing apparatus according to claim 4, wherein said toner-image bearing members are photoconductive drums, having a photoconductive layer on a conductive support.

6. A printing apparatus according to claim 4, wherein, in each of said printing systems, said intermediate toner-receiving member is in the form of a drum or endless belt.

7. A printing apparatus according to claim 6, wherein said intermediate toner-receiving member of said first printing system is a drum and is operated as a drive roller coupled to a speed controllable motor, and said intermediate toner-receiving member of said second printing system is a drum and is operated as a drive roller coupled to a torque controllable motor.

8. A printing apparatus according to claim 7, wherein:

each of said printing systems includes a hot pressure roller associated with said intermediate toner-receiving drum so as to form with said intermediate toner-receiving drum a nip, and said final substrate, by passing through said nip, obtains a translational displacement in synchronism with the peripheral movement of said intermediate toner-receiving drum.

9. A printing apparatus according to claim 1, wherein said apparatus further comprises, between said first and said second printing system, a fusing means for fixing said colour separation images transferred on said final substrate in said first printing system.

10. A printing apparatus according to claim 9, wherein said fusing means comprises a backing roller for said web and a hot roll cooperating with said backing roller while contacting said colour separation images.

11. A printing apparatus according to claim 1, wherein said apparatus further comprises, between said intermediate toner-receiving member of said first printing system and said intermediate toner-receiving member of said second printing system, means for reversing a charge polarity of said colour separation images transferred on said final substrate in said first printing system.

12. A printing apparatus according to claim 1, wherein said toner particles are dry toner particles.

13. A printing apparatus according to claim 1, wherein said toner particles originate from a dispersion of toner particles in a carrier liquid.

14. A printing apparatus according to claim 4, wherein said toner particles are applied to said toner-image bearing members by a magnetic brush.

15. A printing apparatus according to claim 4, wherein said toner particles are nonmagnetic and are applied to said toner-image bearing members by contact development.

16. A printing apparatus according to claim 1, wherein said transferring means is electrically biased.

* * * * *